US010849432B2

(12) United States Patent
Pritchard

(10) Patent No.: US 10,849,432 B2
(45) Date of Patent: Dec. 1, 2020

(54) METHODS AND APPARATUS FOR VARIABLE USER POSITION SEATING

(71) Applicant: Gary Michael Pritchard, Fort Collins, CO (US)

(72) Inventor: Gary Michael Pritchard, Fort Collins, CO (US)

( * ) Notice: Subject to any disclaimer, the term of this patent is extended or adjusted under 35 U.S.C. 154(b) by 86 days.

(21) Appl. No.: 16/191,230

(22) Filed: Nov. 14, 2018

(65) Prior Publication Data

US 2020/0146456 A1 May 14, 2020

(51) Int. Cl.
*A47C 9/00* (2006.01)
*A47C 7/50* (2006.01)
*A47C 7/56* (2006.01)

(52) U.S. Cl.
CPC ..... *A47C 9/002* (2013.01); *A47C 7/503* (2013.01); *A47C 7/5062* (2018.08); *A47C 7/5068* (2018.08); *A47C 7/56* (2013.01)

(58) Field of Classification Search
CPC ..... A47C 9/002; A47C 7/5068; A47C 7/5062; A47C 7/503; A47C 7/56; A47C 7/5066; A63B 23/0211; A63B 23/4035; A63B 23/0428; A63B 23/4047
USPC ..... 297/313
See application file for complete search history.

(56) References Cited

U.S. PATENT DOCUMENTS 1,697,671 A * 1/1929 Watson ..... A47C 7/503 297/423.32
4,589,699 A 5/1986 Dungan
4,614,378 A 9/1986 Picou
4,673,216 A 6/1987 Alfer
4,960,305 A 10/1990 Opsvik
5,054,857 A * 10/1991 Kvalheim ..... A47C 1/027 297/118
5,255,957 A 10/1993 Opsvik et al.
5,490,717 A 2/1996 Greene
5,542,746 A * 8/1996 Bujaryn ..... A47C 9/002 297/423.12
5,605,379 A 2/1997 Weiss
5,667,278 A * 9/1997 Li ..... A47C 9/005 297/423.11
5,720,517 A 2/1998 Prothro, Sr.
6,729,690 B2 * 5/2004 Roleder ..... A47C 9/005 297/16.1
7,628,455 B2 12/2009 Brodeur
(Continued)

OTHER PUBLICATIONS

EBay, "Adjustable bentwood Ergonomic Kneeling Chair Relieve Fatigue Beautify Hips". First accessed Feb. 20, 2018. 5 pages.
(Continued)

*Primary Examiner* — Mark R Wendell
(74) *Attorney, Agent, or Firm* — Santangelo Law Offices, P.C.

(57) ABSTRACT

A system for seated support. A seat rest may be configured to support the posterior of a user, a leg rest may be configured to support a leg portion of a user, and a combined translate-and-cant reposition carriage may be configured to simultaneously translate and cant the position of the leg rest in relation to the position of the seat rest. The seat rest, leg rest, and combined translate-and-cant reposition carriage may comprise an equipoise balancer for a user. The equipoise balancer may be free-floating, lockable, partially lockable, seat-rest driven, or leg rest driven in various embodiments.

49 Claims, 12 Drawing Sheets

(56) References Cited

U.S. PATENT DOCUMENTS

| | | | | |
|---|---|---|---|---|
| 10,010,758 | B2 * | 7/2018 | Osler | A47C 9/002 |
| 2003/0127900 | A1 | 7/2003 | Chen | |
| 2008/0100121 | A1 * | 5/2008 | Serber | A47C 1/023 297/452.1 |
| 2009/0134674 | A1 * | 5/2009 | Deck | A47C 9/002 297/118 |
| 2010/0109387 | A1 * | 5/2010 | Merensky | A47C 7/503 297/75 |
| 2011/0028290 | A1 * | 2/2011 | Ozawa | A63B 21/0085 482/142 |
| 2012/0126595 | A1 * | 5/2012 | Petrucci | A47C 3/02 297/217.6 |
| 2013/0069413 | A1 | 3/2013 | Matthews | |
| 2018/0162236 | A1 * | 6/2018 | Yamauchi | A47C 3/34 |
| 2018/0344036 | A1 * | 12/2018 | Cetrangelo | A63B 21/0428 |

OTHER PUBLICATIONS

Etsy, "AscendantMeditation". First accessed Feb. 20, 2018. 5 pages.
Bipall, "Ergonomic Kneeling Chair, Adjustable Stool (Double Thick Foam) for Home, Office, and Meditation (Mesh)". First accessed Feb. 20, 2018. 4 pages.
Samadhi Cushions, "Meditation Benches: The Seiza Bench and the Cloud Bench". First accessed Feb. 20, 2018. 3 pages.

* cited by examiner

METHODS AND APPARATUS FOR VARIABLE USER POSITION SEATING

BACKGROUND

The present inventive technology relates to the field of user seating and accommodating various user seated positions therein. The present inventive technology may particularly accommodate, but not be limited to, the seated position of a user engaged in a meditation practice and like forms of seating.

Meditation practice often involves the practitioner assuming a seated posture, such as with crossed legs or in a kneeling posture, and often for an extended period of time. Conventional devices for supporting the user in such seated postures may typically entail a number of drawbacks. For example, conventional seating devices often may be configured for either cross-legged seating or kneeling, but not both, or even where both types of seating possibly might be accommodated, by restricting or offering limited utility, convenience, or comfort in one posture at the expense of the other. Conventional devices also may require up-front adjustment, perhaps requiring the user to set, try out, and re-set various adjustments until a desired seating posture is attained, rather than having adjustments that respond to the weight and position of the user on the device. Moreover, the range of adjustability of conventional devices may not be able to respond to users of varying body sizes and flexibilities, as may happen for users spanning the range from novice to expert in areas such as fitness level and meditation practice experience. The adjustability of conventional devices also may not effectively relieve pressure on hips and knees that the seated postures described herein may entail. Finally, while the drawbacks described herein may be described in terms of seating for meditation practices or the like, these drawbacks naturally may arise for any seating practices or environments that implicate these issues.

The foregoing problems related to conventional seating devices may represent a long-felt need for an effective solution to the same. While implementing elements may have been available, actual attempts to meet this need may have been lacking to some degree. This may have been due to a failure of those having ordinary skill in the art to fully appreciate or understand the nature of the problems and challenges involved. As a result of this lack of understanding, attempts to meet these long-felt needs may have failed to effectively solve one or more of the problems or challenges here identified. These attempts may even have led away from the technical directions taken by the present inventive technology and may even result in the achievements of the present inventive technology being considered to some degree an unexpected result of the approach taken by some in the field.

SUMMARY OF THE INVENTIVE TECHNOLOGY

In one embodiment, an object of the inventive technology may be to provide a seat rest configured to support the posterior of a user, a leg rest configured to support a leg portion of a user, and a combined translate-and-cant reposition carriage configured to simultaneously translate and cant the position of the leg rest in relation to the seat rest.

In another embodiment, an object of the inventive technology may be to provide a seat rest, a leg rest, and a combined translate-and-cant reposition carriage as an equipoise balancer for a user.

Naturally, further objects of the inventive technology will become apparent from the description and drawings below.

DETAILED DESCRIPTION OF THE PREFERRED EMBODIMENTS

Figure 1:
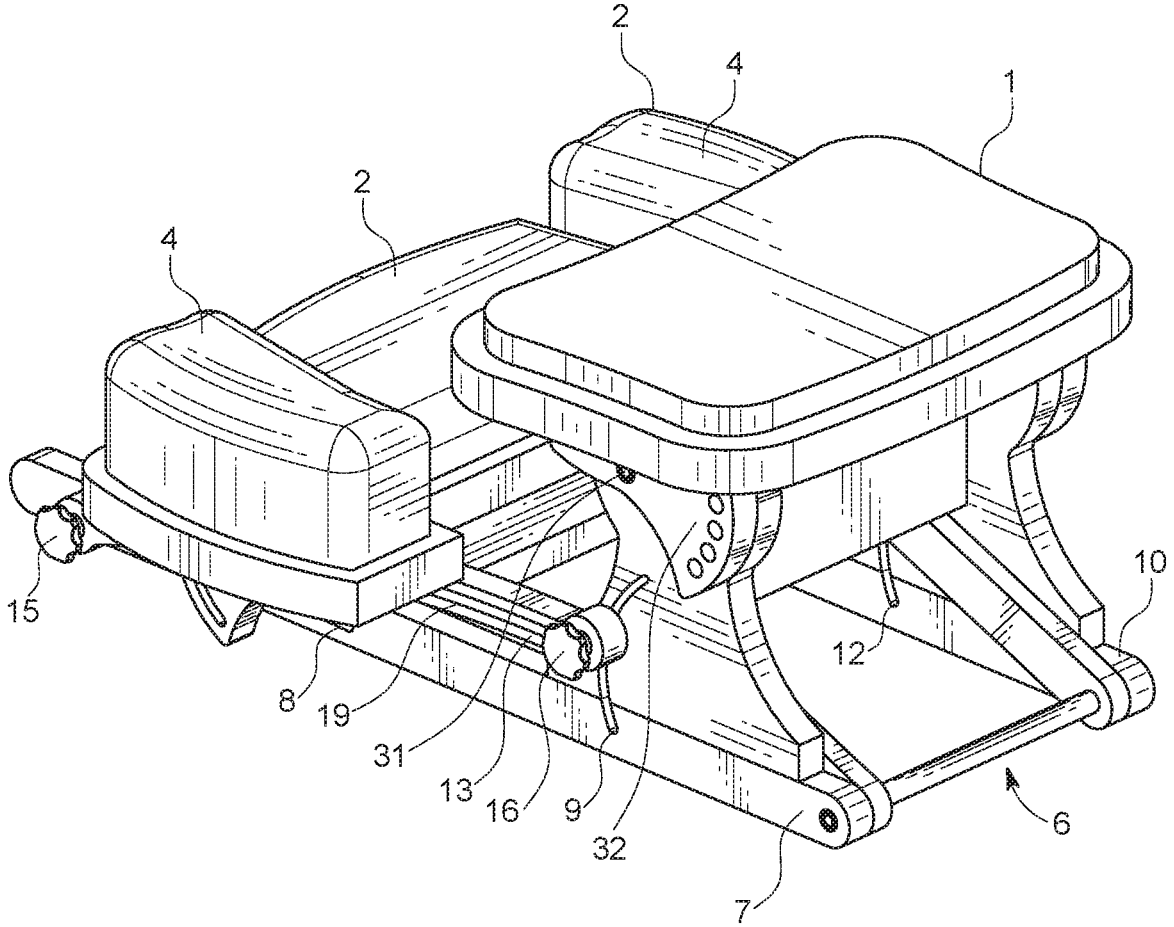
FIG. 1 is a perspective view of a seated support apparatus in one exemplary embodiment.

As mentioned earlier, the present inventive technology includes a variety of aspects, which may be combined in different ways. The following descriptions are provided to list elements and describe some of the embodiments of the present inventive technology. These elements are listed with initial embodiments; however, it should be understood that they may be combined in any manner and in any number to create additional embodiments. The variously described examples and preferred embodiments should not be construed to limit the present inventive technology to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments is not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

In various embodiments, the inventive technology may involve a seated support apparatus and methods for seated support.

The inventive technology may include a seat rest (1) configured to support the posterior of a user. The seat rest (1) may be of any size, shape, or kind that is consistent with the inventive principles described herein. Various embodiments accordingly may involve supporting the posterior of a user with a seat rest (1).

The inventive technology also may include a leg rest (2) configured to support a leg portion of a user. The leg rest (2) may be of any size, shape, or kind that is consistent with the inventive principles described herein. In various embodiments, the leg rest (2) may be suitable for one or both of a kneeling posture and a cross-legged posture of a user, supporting the portions of the user's legs as required by those postures. For example, the leg rest (2) in some embodiments may have a recessed central portion (3) suitable for receiving the knees or shins of a user in a kneeling position, and raised wings (4) suitable for receiving the knees or shins of a user in a cross-legged posture. The recessed portion (3) and raised wings (4) may be of any size, shape, or kind that is consistent with the inventive principles described herein. Various embodiments accordingly may involve supporting a leg portion of a user with a leg rest (2).

The inventive technology also may include a combined translate-and-cant reposition carriage (5) configured to simultaneously translate and cant the position of leg rest (2) in relation to seat rest (1). Any carriage suitable to reposition the leg rest (2) and the seat rest (1) with respect to one another that is consistent with the inventive principles described herein may be utilized, such as by moving leg rest (2) with respect to seat rest (1), moving seat rest (1) with respect to leg rest (2), or moving both with respect to one another. Various embodiments accordingly may involve simultaneously translating and canting the position of a leg rest (2) in relation to a seat rest (1) with a combined translate-and-cant reposition carriage (5).

The combination of translation and cant of the leg rest (2) may occur simultaneously as a function of repositioning the leg rest (2). For example, repositioning the leg rest (2) closer to the seat rest (1) in some embodiments may involve leveling the cant of the leg rest (2) simultaneously while its position is being translated toward the seat rest (1). Similarly, repositioning the leg rest (2) away from the seat rest (1) in some embodiments may involve steepening the cant of the leg rest (2) simultaneously while its position is being translated away from seat rest (1). However, the inventive technology contemplates any simultaneous translation and cant of the leg rest (2) as a function of its position that is consistent with the inventive principles herein.

In some embodiments, a seated support apparatus may have an H-shaped base (6) and a method for seated support may involve supporting a user on the H-shaped base (6). Such H-shaped base (6) described herein is to be understood to be disclosed broadly, such as including any base having two legs and a lateral support generally in the shape of or including structure configured as an "H." For example, in various embodiments the legs of the "H" may be straight, curved, or irregular; the lateral support of the "H" may connect at any points of the legs; the "H" may include more than one lateral support, including any number or manner of supporting cross connectors and including via crosspieces disposed through slots as described elsewhere herein; the legs of the "H" may or may not be parallel; and the like.

In some embodiments, the left leg (7) of an H-shaped base (6) may have a left forward translate-and-cant slot (8) and a left rear translate-and-cant slot (9), and a right leg (10) of an H-shaped base (6) may have a right forward translate-and-cant slot (11) (not shown in the Figures due to perspective, but the mirror image of (8) for the embodiments shown therein) and a right rear translate-and-cant slot (12). A combined translate-and-cant reposition carriage (5) may have a left rail (13) and a right rail (14), with the left rail (13) joined to the left leg (7) of the H-shaped base (6) at a left forward crosspiece (15) disposed through the left forward translate-and-cant slot (8) and a left rear crosspiece (16) disposed through the left rear translate-and-cant slot (9), and with the right rail (14) joined to the right leg (10) of the H-shaped base (6) at a right forward crosspiece (17) disposed through the right forward translate-and-cant slot (11) and a right rear crosspiece (18) disposed through the right rear translate-and-cant slot (12).

These slots and crosspieces may allow the combined translate-and-cant reposition carriage (5) to move on the H-shaped base (6). For example, simultaneously translating and canting the position of the leg rest (2) in relation to the seat rest (1) with the carriage may involve moving the left rail (13) and the right rail (14) of the carriage relative to the left leg (7) and the right leg (10) of the base. This may be accomplished by moving the left rail (13) relative to the left leg (7) by moving the left forward crosspiece (15) through the left forward translate-and-cant slot (8) and moving the left rear crosspiece (16) through the left rear translate-and-cant slot (9), and moving the right rail (14) relative to the right leg (10) by moving the right forward crosspiece (17) through the right forward translate-and-cant slot (11) and moving the right rear crosspiece (18) through the right rear translate-and-cant slot (12).

It may be appreciated that configuration of these slots and the movement of these crosspieces therein may define the nature of the movement of the combined translate-and-cant reposition carriage (5). With respect to the embodiments shown in the Figures, for example, the configuration of the forward slots as substantially straight and level combined with the configuration of the rear slots as substantially arcuate and vertical means that as the carriage moves as a result of cooperation of the movement of the crosspieces in the slots, it will simultaneously translate and cant. Accordingly, in some embodiments each forward translate-and-cant slot may be a substantially horizontal translate-and-cant slot and/or a substantially straight translate and cant slot, and each rear translate-and-cant slot may be a substantially non-horizontal translate-and-cant slot and/or a substantially arcuate translate-and-cant slot. Moreover, in various embodiments moving forward crosspieces through the forward translate-and-cant slots (8, 11) may involve horizontally or substantially horizontally moving the forward crosspieces or moving the forward crosspieces in a straight or substantially straight line, and moving the rear crosspieces through the rear translate-and-cant slots (9, 12) may involve non-horizontally or substantially non-horizontally moving the rear crosspieces or moving the rear crosspieces in an arcuate or substantially arcuate curve.

Of course, the embodiments shown in the Figures are illustrative in nature, and the configuration of the slots and crosspieces may be of any kind or arrangement suitable to achieve simultaneous translation and cant that is consistent with the inventive principles described herein.

In some embodiments, a combined translate-and-cant reposition carriage (5) may be configured to translate and cant the position of the leg rest (2) in a fixed relationship defined by the cooperation of the movement of the crosspieces in the slots, such as wherein any given value for translation has one corresponding value for cant and vice versa, and such as may naturally follow where crosspieces move through slots in substantially linear motion. Accordingly, in various embodiments simultaneously translating and canting may involve fixing the relationship of translation to cant, such as by the cooperation of moving crosspieces within slots.

In various embodiments, a leg rest (2) may be a translatable leg rest (2), such as wherein the leg rest (2) may itself be capable of translation even apart from the translation of the combined translate-and-cant reposition carriage (5).

In some embodiments, a translatable leg rest (2) may be translatable on a combined translate-and-cant reposition carriage (5). For example, a translate-and-cant reposition carriage (5) may have a left leg rest translation slot (19) of a left rail (13) of the carriage and a right leg rest translation slot (20) (not shown in the Figures due to perspective, but the mirror image of (19) for the embodiments shown therein) of the right rail (14) of the carriage. A translatable leg rest (2) may have a left leg rest translation crosspiece (21) disposed through the left leg rest translation slot (19) and a right leg rest translation crosspiece (22) disposed through the right leg rest translation slot (20).

It may be appreciated that configuration of these slots and the movement of these crosspieces therein may allow a translatable leg rest (2) to move on a combined translate-and-cant reposition carriage (5). Some embodiments may involve translating a translatable leg rest (2), which may involve moving a left leg rest translation crosspiece (21) of the translatable leg rest (2) through a left leg rest translation slot (19) of the left rail (13) of the combined translate-and-cant reposition carriage (5), and moving a right leg rest translation crosspiece (22) of the translatable leg rest (2) through a right leg rest translation slot (20) of the right rail (14) of the combined translate-and-cant reposition carriage (5).

In various embodiments, a leg rest (2) may be a tiltable leg rest (2). The surface of the leg rest (2) may be capable of being tilted to an angle, such as to accommodate the angle of the leg portion of the user that may be supported by the tiltable leg rest (2). Naturally, the range of tilt may be any as may be implemented and found to be suitable for use as consistent with the inventive principles described herein.

In some embodiments, a left leg rest translation crosspiece (21) may be a front left leg rest translation crosspiece (23) disposed through a left leg rest translation slot (19) of a left rail (13), and there may be a rear left leg rest translation crosspiece (24) disposed through the left leg rest translation slot (19) of the left rail (13). Similarly, a right leg rest translation crosspiece (22) may be a front right leg rest translation crosspiece (25) (not shown in the Figures due to perspective, but the mirror image of (23) for the embodiments shown therein) disposed through a right leg rest translation slot (20) of a right rail (14), and there may be a rear right leg rest translation crosspiece (26) (not shown in the Figures due to perspective, but the mirror image of (24) for the embodiments shown therein) disposed through the right leg rest translation slot (20) of the right rail (14). A tiltable leg rest (2) may have a left pivot point (27) joined to the rear left leg rest translation crosspiece (24) and right pivot point (28) (not shown in the Figures due to perspective, but the mirror image of (27) for the embodiments shown therein) joined to the rear right leg rest translation crosspiece (26), and a left tilt slot (29) through which the front left leg rest translation crosspiece (23) is disposed and a right tilt slot (30) (not shown in the Figures due to perspective, but the mirror image of (29) for the embodiments shown therein) through which the front right leg rest translation crosspiece (25) is disposed.

It may be appreciated that the configuration of these slots, pivot points, and crosspieces, and the movements therein enabled, may allow a tiltable leg rest (2) to tilt. Some embodiments may involve tilting a tiltable leg rest (2), which may involve pivoting a left pivot point (27) about a rear left leg rest translation crosspiece (24) and pivoting a right pivot point (28) about a rear right leg rest translation crosspiece (26), and moving a front left leg rest translation crosspiece (23) through a left tilt slot (29) and moving a front right leg rest translation crosspiece (25) through a right tilt slot (30).

In various embodiments, a seat rest (1) may be tiltably joined to an H-shaped base (6). This may involve at least one seat rest pivot point (31) of the H-shaped base (6), at least one seat rest pivot slot (32) of the H-shaped base (6), at least one seat rest pivot point (33) of the seat rest (1) joined to the at least one seat rest pivot point (31) of the H-shaped base (6), and at least one seat rest crosspiece (34) disposed through the at least one seat rest pivot slot (32) of the H-shaped base (6). In various embodiments, a seat rest pivot point (31) may be a single pivot point, or may be a pivot axis such as defined by opposed pivot points or the like on opposing structures or the like of an H-shaped base (6). Similarly, in various embodiments a seat rest pivot slot (32) may be a single pivot slot, or may be pivot plane defined by opposed pivot slots or the like on opposing structures or the like of an H-shaped base.

It may be appreciated that the configuration of these slots, pivot points, and crosspieces, and the movements therein enabled, may allow a tiltable seat rest (1) to tilt. Some embodiments may involve tilting a seat rest (2) relative to an H-shaped base (1), which may involve pivoting at least one seat rest pivot point (33) of the seat rest (1) about at least one seat rest pivot point (31) of the H-shaped base (6), and moving at least one seat rest crosspiece (34) of the seat rest (1) through at least one seat rest pivot slot (32) of the H-shaped base (6).

A slot, as discussed for various embodiments herein, may serve to provide some or all guidance of the movement of a crosspiece disposed therein, and may be of any size, shape or kind that is consistent with the inventive principles discussed herein. For example, a slot in various embodiments may be a straight or substantially straight slot, an arcuate or substantially arcuate slot, a horizontal or substantially horizontal slot, a non-horizontal or substantially non-horizontal slot, a slot having a relatively higher position as compared to another slot, a slot having a relatively lower position as compared to another slot, a slot having any combination of the foregoing or other features, and a slot in a combination of slots having any combination of the foregoing or other features. Moreover, in various embodiments moving a crosspiece through a slot may involve moving a crosspiece through a substantially straight slot, moving a crosspiece through a substantially arcuate slot, moving a crosspiece through a substantially horizontal slot, moving a crosspiece through a substantially non-horizontal slot, moving a crosspiece through a slot that is relatively higher to another slot, moving a crosspiece through a slot that is relatively lower to another slot, moving a crosspiece through a slot having any combination of the foregoing, and moving multiple crosspieces through multiple slots having any combination of the foregoing.

A crosspiece, as discussed for various embodiments herein, may be any thing capable of being disposed through a slot such that the slot may guide the movement of the crosspiece disposed therein. For example, in various embodiments a crosspiece may slidingly engage with the sides of a slot. Examples of crosspieces may include bars, rods, pegs, shafts, or the like, and crosspieces may be of any size, shape, or kind that is consistent with the inventive principles described herein.

Any or all of the crosspieces described herein may be tightening members in some embodiments. A crosspiece configured as a tightening member may serve to fix the position of a crosspiece within a slot, such as by tightening the crosspiece against the sides of the slot to which it otherwise may be slidingly engaged. Examples of crosspieces configured as tightening members may include by frictional engagement, such as actuated by a screw. However, a crosspiece configured as a tightening member may be of any size, shape or kind that is consistent with the inventive principles discussed herein. Accordingly, various embodiments may involve tightening a tightening member of any or all crosspieces.

In some embodiments, a crosspiece may comprise all or part of the lateral support of an H-shaped base (6). In addition to enabling movement through one or more slots such as has been described herein, the crosspiece may connect opposing sides of the H-shaped base (6) to provide lateral support therefore. For example, in some embodiments a crosspiece may be the end or ends of a bar or the like spanning the area between the two legs of an H-shaped base (6), wherein the end or ends of the bar may be disposed through a slot or slots, and such portion or portions of the bar may serve as a crosspiece or crosspieces such as has been described herein. Accordingly, various embodiments may involve laterally supporting an H-shaped base (6) with any crosspiece.

In some embodiments, at least one crosspiece may be a self-positioning crosspiece configured to respond to a user attribute, such as the seated weight of a user, the seated position of a user, or the like. A crosspiece may find its own position in a slot in response to an applied force. For example, the force may be applied such as by the weight of a user seated on seat rest (1), as wherein the user's weight may drive the position of one or more self-positioning crosspieces in their respective slot or slots, or even by the position or change in position of the user seated on the seat rest (1), as wherein the change may redistribute the allocation of applied force to the self-positioning crosspiece or crosspieces, causing them to find a new position within their slot or slots. Accordingly, moving a crosspiece in various embodiments may involve self-positioning the crosspiece, such as by responding to the seated weight of a user, the seated position of a user, or the like.

In various embodiments, some or all of such self-positioning crosspieces may be an equipoise balancer for the user. Equipoise may be understood to involve a distribution of the weight, position, or the like of the user on a seated support apparatus that is desired by the user. An equipoise balancer may serve to create such a distribution by shifting the configuration of the components of the seated support apparatus, as wherein the force applied by the user's desired weight distribution or position drives one or more self-positioning crosspieces to find their accommodating positions within their respective slots. Accordingly, in various embodiments self-positioning one or more crosspieces may involve balancing a user in equipoise.

In some embodiments, an equipoise balancer may be a free-floating equipoise balancer. A free-floating equipoise balancer may involve no restrictions or limitations on finding balance other than the weight, position, or like of the user, such as wherein one or more self-positioning crosspieces may find their position strictly based on applied force generated by the user. In this manner, it may be seen that a user may freely float in equipoise on the seated support apparatus, with changes in equipoise due to shifting of weight, position, or the like freely accommodated by the equipoise balancer. Accordingly, in various embodiments balancing a user in equipoise may involve allowing the user to freely float in equipoise.

In some embodiments, an equipoise balancer may be a lockable equipoise balancer. Self-positioning crosspieces that have found their position may be locked in place or otherwise secured to prevent their further movement. In this manner, it may be seen, for example, that a user may lock a certain balance of equipoise into place, such as wherein the user may find a certain equipoise balance to be sufficient and may not wish further shifts of weight, position, or the like to change such equipoise balance. Accordingly, in various embodiments balancing a user in equipoise may involve locking an equipoise balance of the user in place.

Embodiments also may include a partially lockable equipoise balancer, as wherein one or more, but not all, self-positioning crosspieces that have found their position may be locked in place or otherwise secured to prevent further movement. In this manner, it may be seen, for example, that a user may lock certain components of equipoise into place while allowing others to float freely. Accordingly, in various embodiments balancing a user in equipoise may involve partially locking an equipoise balance of the user in place.

In some embodiments, an equipoise balancer may be a seat rest driven equipoise balancer. Changes in the user's distribution of weight, position, or the like may be transmitted through the user's contact with the seat rest (1), and the resulting applied force may be applied through the seat rest (1) to drive the various components of the equipoise balancer. For example, in some embodiments a user may achieve equipoise balance perhaps simply by tilting the seat rest (1), and the rest of the equipoise balancer components may shift position accordingly. Accordingly, in various embodiments balancing a user in equipoise may involve driving equipoise balance with a seat rest (1).

In some embodiments, an equipoise balancer may be a leg rest driven equipoise balancer. Changes in the user's distribution of weight, position, or the like may be transmitted through the user's contact with the leg rest (2), and the resulting applied force may be applied through the seat rest (2) to drive the various components of the equipoise balancer. For example, in some embodiments a user may achieve equipoise balance perhaps simply by translating, canting, and/or tilting the leg rest (2), and the rest of the equipoise balancer components may shift position accordingly. Accordingly, in various embodiments balancing a user in equipoise may involve driving equipoise balance with a leg rest (1).

It may be appreciated that one effect of the seated support apparatus and methods for seated support described herein may be to relieve the pressure on the knees and hips of users engaged in a seated position of a meditation practice or like kinds of seated positions. For example, the leg rest (2) may have at least three degrees of freedom of adjustability (e.g., translation-and-cant, translation on a combined translate-and-cant reposition carriage (5), and tilt), which themselves may be augmented by perhaps a fourth or even more degrees of adjustability conferred by the seat rest (1). Moreover, these degrees of freedom of adjustability may be implemented through ranges of motion having forms particularly suited to relieving such pressures on the knees and hips of users. For example, the particular degrees of freedom of adjustability described herein may be particularly suited for accommodating both angle and spacing issues that come from kneeling postures versus cross-legged postures. The aspects of the inventive technology relating to equipoise balance also may allow users to fine tune these degrees of freedom of adjustability to a high level of precision specifically targeting the needs of individual users. For example, individual users may find a suitable equipoise balance to eliminate pressure on knees and hips, perhaps even as those pressure points may change from seating to seating.

It may be appreciated that the inventive principles described herein in part include the motions of the parts of the seated support apparatus and the methods for seated support described, and that the slots and crosspieces described may be selected, configured, and implemented in any manner consistent with the inventive principles described herein to effect the same. In addition, the inventive technology is understood and hereby disclosed to encompass not just the specific slots and crosspieces described herein, but any size, shape, or kind of slot or crosspiece in any combination or configuration that is consistent with the inventive principles described herein.

Moreover, for those aspects of the inventive principles stemming from motions and parts generally, and not specifically from the crosspieces and slots (which themselves should be understood separately and independently to embody inventive principles of the inventive technology described herein), it is understood and herein disclosed that any appropriate hardware, software, or the like suitable to achieve the effect or effects of the slots and crosspieces described herein may be utilized that are consistent with the inventive principles discussed herein. Examples may include, but are not limited to, rails, wheels, cables, pulleys, electric motors, computer control, and the like.

Accordingly, it may be seen that any inventive aspects of the inventive technology that may be implemented without use of the slots and crosspieces herein described are acknowledged, understood, and disclosed herein.

For example, embodiments of the inventive technology broadly may include a combined translate-and-cant reposition carriage configured to simultaneously translate and cant the position of a leg rest in a fixed relationship, a translatable leg rest configured for translation relative to a combined translate-and-cant reposition carriage, a tiltable translatable leg rest configured for tilt on a combined translate-and-cant reposition carriage, and a tiltable seat rest, even where embodiments of any of the foregoing may not specifically utilize the slots and crosspieces described herein. Embodiments also may involve translating a leg rest (2) on a combined translate-and-cant reposition carriage (5), tilting a leg rest (2) on a combined translate-and-cant reposition carriage (5), and tilting a seat rest (1), even where embodiments of any of the foregoing may not specifically involve moving crosspieces through slots as described herein.

Similarly, embodiments of the inventive technology may involve a seat rest, leg rest, and combined translate-and-cant reposition carriage that comprise an equipoise balancer for a user, which may be a free-floating equipoise balancer, a lockable equipoise balancer, a partially lockable equipoise balancer, a seat rest driven equipoise balancer, and a leg rest driven equipoise balancer, even where embodiments of any such equipoise balancer may not specifically utilize the slots and crosspieces described herein. In various embodiments, supporting with a seat rest (1) and a leg rest (2) and simultaneously translating and canting with a combined translate-and-cant reposition carriage (5) as have been described herein may involve balancing a user in equipoise, which may include allowing the user to freely float in equipoise, locking an equipoise balance in place, partially locking an equipoise balance in place, driving equipoise balance with a seat rest (1), and driving equipoise balance with a leg rest (2), even where embodiments of any of the foregoing may not specifically involve moving crosspieces through slots as described herein. Moreover, balancing a user in equipoise may involve any or all of translating a leg rest (2) on a combined translate-and-cant reposition carriage (5), tilting a leg rest (2) on a combined translate-and-cant reposition carriage (5), and tilting a seat rest (1), again even where embodiments of any of the foregoing may not specifically involve moving crosspieces through slots as described herein.

Various embodiments herein may be described in terms of joining one thing to another. Joining may be understood broadly to involve bringing such things into contact, connecting them, or otherwise putting them together. Any kind of joining consistent with the inventive principles discussed herein is contemplated and hereby disclosed, including without limit making physical connections, resting things with respect to one another by gravity, abutting things together, and the like.

For items herein having element numbers described as being the mirror image of other element numbers in the embodiments shown in the Figures, such description should be understood to describe and disclose the mirror image of any drawing in the Figures sufficient to show the mirrored element number.

Examples of alternative claims include:

1. A seated support apparatus comprising:
   a seat rest configured to support the posterior of a user;
   a leg rest configured to support a leg portion of said user;
   a combined translate-and-cant reposition carriage configured to simultaneously translate and cant the position of said leg rest in relation to said seat rest.
2. A seated support apparatus as described in clause 1 or any other clause, further comprising an H-shaped base having:
   a left forward translate-and-cant slot and a left rear translate-and-cant slot of a left leg of said H-shaped base;
   a right forward translate-and-cant slot and a right rear translate-and-cant slot of a right leg of said H-shaped base;
   and wherein said combined translate-and-cant reposition carriage comprises:
   a left rail joined to said left leg of said H-shaped base at a left forward crosspiece disposed through said left forward translate-and-cant slot and a left rear crosspiece disposed through said left rear translate-and-cant slot;
   a right rail joined to said right leg of said H-shaped base at a right forward crosspiece disposed through said right forward translate-and-cant slot and a right rear crosspiece disposed through said right rear translate-and-cant slot.
3. A seated support apparatus as described in clause 2 or any other clause, wherein said combined translate-and-cant reposition carriage comprises a combined translate-and-cant reposition carriage configured to translate and cant the position of said leg rest in a fixed relationship defined by the cooperation of the movement of said crosspieces in said slots.
4. A seated support apparatus as described in clause 2 or any other clause, wherein each said forward translate-and-cant slot comprises a substantially horizontal translate-and-cant slot, and wherein each said rear translate-and-cant slot comprises a substantially non-horizontal translate-and-cant slot.

5. A seated support apparatus as described in clause 2 or any other clause, wherein each said forward translate-and-cant slot comprises a substantially straight translate-and-cant slot, and wherein each said rear translate-and-cant slot comprises a substantially arcuate translate-and-cant slot.

6. A seated support apparatus as described in clause 2 or any other clause, wherein said leg rest comprises a translatable leg rest.

7. A seated support apparatus as described in clause 6 or any other clause, wherein said translate-and-cant reposition carriage further comprises:
   a left leg rest translation slot of said left rail of said translate-and-cant reposition carriage;
   a right leg rest translation slot of said right rail of said translate-and-cant reposition carriage;
   and wherein said translatable leg rest comprises:
   a left leg rest translation crosspiece disposed through said left leg rest translation slot of said left rail;
   a right leg rest translation crosspiece disposed through said right leg rest translation slot.

8. A seated support apparatus as described in clause 7 or any other clause, wherein said leg rest comprises a tiltable leg rest.

9. A seated support apparatus as described in clause 8 or any other clause, wherein:
   said left leg rest translation crosspiece comprises a front left leg rest translation crosspiece disposed through said left leg rest translation slot of said left rail, and further comprising a rear left leg rest translation crosspiece disposed through said left leg rest translation slot of said left rail;
   said right leg rest translation crosspiece comprises a front right leg rest translation crosspiece disposed through said right leg rest translation slot of said right rail, and further comprising a rear right leg rest translation crosspiece disposed through said right leg rest translation slot of said right rail;
   and wherein said tiltable leg rest comprises:
   a left pivot point of said tiltable leg rest joined to said rear left leg rest translation crosspiece and a right pivot point of said tiltable leg rest joined to said rear right leg rest translation crosspiece;
   a left tilt slot of said tiltable leg rest through which said front left leg rest translation crosspiece is disposed and a right tilt slot of said tiltable leg rest through which said front right leg rest translation crosspiece is disposed.

10. A seated support apparatus as described in clause 9 or any other clause, wherein said seat rest comprises a seat rest tiltably joined to said H-shaped base.

11. A seated support apparatus as described in clause 10 or any other clause, wherein said H-shaped base comprises:
   at least one seat rest pivot point of said H-shaped base;
   at least one seat rest pivot slot of said H-shaped base;
   and wherein said seat rest tiltably joined to said H-shaped base comprises:
   at least one seat rest pivot point of said seat rest joined to said at least one seat rest pivot point of said H-shaped base;
   at least one seat rest crosspiece disposed through said at least one seat rest pivot slot of said H-shaped base.

12. A seated support apparatus as described in clause 11 or any other clause, wherein any said crosspiece comprises a tightening member.

13. A seated support apparatus as described in clause 11 or any other clause, wherein any said crosspiece comprises part of a lateral support of said H-shaped base.

14. A seated support apparatus as described in clause 11 or any other clause, wherein any said slot comprises a slot selected from the group consisting of a substantially straight slot, a substantially arcuate slot, a substantially horizontal slot, a substantially non-horizontal slot, a slot having a relatively higher position to another slot, a slot having a relatively lower position to another slot, any slot having any combination of the foregoing, and any combination of slots having any combinations of the foregoing.

15. A seated support apparatus as described in clause 11 or any other clause, wherein at least one said crosspiece comprises a self-positioning crosspiece configured to respond to a user attribute selected from the group consisting of the seated weight of said user and the seated position of said user.

16. A seated support apparatus as described in clause 15 or any other clause, wherein all said self-positioning crosspieces comprise an equipoise balancer for said user.

17. A seated support apparatus as described in clause 16 or any other clause, wherein said equipoise balancer comprises a free-floating equipoise balancer.

18. A seated support apparatus as described in clause 16 or any other clause, wherein said equipoise balancer comprises an equipoise balancer selected from the group consisting of a lockable equipoise balancer and a partially lockable equipoise balancer.

19. A seated support apparatus as described in clause 16 or any other clause, wherein said equipoise balancer comprises an element selected from the group consisting of a seat rest driven equipoise balancer and a leg rest driven equipoise balancer.

20. A seated support apparatus as described in clause 1 or any other clause, wherein said combined translate-and-cant reposition carriage comprises a combined translate-and-cant reposition carriage configured to simultaneously translate and cant the position of said leg rest in a fixed relationship.

21. A seated support apparatus as described in clause 20 or any other clause, wherein said leg rest comprises a translatable leg rest configured for translation on said combined translate-and-cant reposition carriage.

22. A seated support apparatus as described in clause 21 or any other clause, wherein said translatable leg rest further comprises a tiltable translatable leg rest configured for tilt on said combined translate-and-cant reposition carriage.

23. A seated support apparatus as described in clause 22 or any other clause, wherein said seat rest comprises a tiltable seat rest.

24. A seated support apparatus as described in clause 1 or any other clause, wherein said seat rest, said leg rest, and said combined translate-and-cant reposition carriage comprise an equipoise balancer for said user.

25. A seated support apparatus as described in clause 24 or any other clause, wherein said equipoise balancer comprises an equipoise balancer selected from the group consisting of a free-floating equipoise balancer, a lockable equipoise balancer, a partially lockable equipoise balancer, a seat rest driven equipoise balancer, and a leg rest driven equipoise balancer.

26. A seated support apparatus as described in clause 24 or any other clause, wherein said leg rest comprises a translatable leg rest configured for translation on said combined translate-and-cant reposition carriage, and wherein said translatable leg rest further comprises a tiltable translatable leg rest configured for tilt on said combined translate-and-cant reposition carriage, and wherein said seat rest comprises a tiltable seat rest.

27. A method for seated support comprising the steps of:
supporting the posterior of a user with a seat rest;
supporting a leg portion of said user with a leg rest;
simultaneously translating and canting the position of said leg rest in relation to said seat rest with a combined translate-and-cant reposition carriage.

28. A method for seated support as described in clause 27 or any other clause, further comprising the step of supporting said user on an H-shaped base and wherein said step of simultaneously translating and canting comprises the steps of moving a left rail and a right rail of said combined translate-and-cant reposition carriage by:
moving said left rail relative to a left leg of said H-shaped base by moving a left forward crosspiece of said left rail through a left forward translate-and-cant slot of said left leg of said H-shaped base and moving a left rear crosspiece of said left rail through a left rear translate-and-cant slot of said left leg of said H-shaped base;
moving said right rail relative to a right leg of said H-shaped base by moving a right forward crosspiece of said right rail through a right forward translate-and-cant slot of said right leg of said H-shaped base and moving a right rear crosspiece of said right rail through a right rear translate-and-cant slot of said right leg of said H-shaped base.

29. A method for seated support as described in clause 28 or any other clause, wherein said step of simultaneously translating and canting comprises the step of fixing the relationship of said translation to said cant by the cooperation of moving said crosspieces in said slots.

30. A method for seated support as described in clause 28 or any other clause, wherein said steps of moving said forward crosspieces through said forward translate-and-cant slots comprise the steps of substantially horizontally moving said forward crosspieces, and wherein said steps of moving said rear crosspieces through said rear translate-and-cant slots comprise the steps of substantially non-horizontally moving said rear crosspieces.

31. A method for seated support as described in clause 28 or any other clause, wherein said steps of moving said forward crosspieces through said forward translate-and-cant slots comprise the steps of moving said forward crosspieces in a substantially straight line, and wherein said steps of moving said rear crosspieces through said rear translate-and-cant slots comprise the steps of moving said rear crosspieces in a substantially arcuate curve.

32. A method for seated support as described in clause 28 or any other clause, further comprising the step of translating said leg rest.

33. A method for seated support as described in clause 32 or any other clause, wherein said step of translating said leg rest comprises the steps of:
moving a left leg rest translation crosspiece of said leg rest through a left leg rest translation slot of said left rail of said translate-and-cant reposition carriage;
moving a right leg rest translation crosspiece of said leg rest through a right leg rest translation slot of said right rail of said translate-and-cant reposition carriage.

34. A method for seated support as described in clause 33 or any other clause, further comprising the step of tilting said leg rest.

35. A method for seated support as described in clause 34 or any other clause, wherein said step of tilting said leg rest comprises the steps of:
pivoting a left pivot point of said leg rest about a rear left leg rest translation crosspiece of said leg rest and pivoting a right pivot point of said leg rest about a rear right leg rest translation crosspiece of said leg rest;
moving a front left leg rest translation crosspiece of said leg rest through a left tilt slot of said leg rest and moving a front right leg rest translation crosspiece of said leg rest through a right tilt slot of said leg rest.

36. A method for seated support as described in clause 35 or any other clause, further comprising the step of tilting said seat rest relative to said H-shaped base.

37. A method for seated support as described in clause 36 or any other clause, wherein said step of tilting said seat rest comprises the steps of:
pivoting at least one seat rest pivot point of said seat rest about at least one seat rest pivot point of said H-shaped base;
moving at least one seat rest crosspiece of said seat rest through at least one seat rest pivot slot of said H-shaped base.

38. A method for seated support as described in clause 37, or any other clause, further comprising the step of tightening a tightening member of any said crosspiece.

39. A method for seated support as described in clause 37, further comprising the step of laterally supporting said H-shaped base with any said crosspiece.

40. A method for seated support as described in clause 37 or any other clause, wherein any said step of moving a crosspiece through a slot comprises a step selected from the group consisting of moving said crosspiece through a substantially straight slot, moving said crosspiece through a substantially arcuate slot, moving said crosspiece through a substantially horizontal slot, moving said crosspiece through a substantially non-horizontal slot, moving said crosspiece through a slot that is relatively higher to another slot, moving said crosspiece through a slot that is relatively lower to another slot, moving said crosspiece through a slot having any combination of the foregoing, and moving multiple said crosspieces through multiple slots having any combination of the foregoing.

41. A method for seated support as described in clause 37 or any other clause, wherein at least one said step of moving a crosspiece comprises the step of self-positioning said crosspiece selected from the group consisting of by responding to the seated weight of said user and by responding to the seated position of said user.

42. A method for seated support as described in clause 41 or any other clause, wherein all said steps of self-positioning comprise the step of balancing said user in equipoise.

43. A method for seated support as described in clause 42 or any other clause, wherein said step of balancing said user in equipoise comprises the step of allowing said user to freely float in equipoise.

44. A method for seated support as described in clause 42 or any other clause, wherein said step of balancing said user in equipoise comprises a step selected from the group consisting of locking said equipoise balance in place and partially locking said equipoise balance in place.

45. A method for seated support as described in clause 42 or any other clause, wherein said step of balancing said user in equipoise comprises a step selected from the group consisting of driving equipoise balance with said seat rest and driving equipoise balance with said leg rest.

Figure 2:
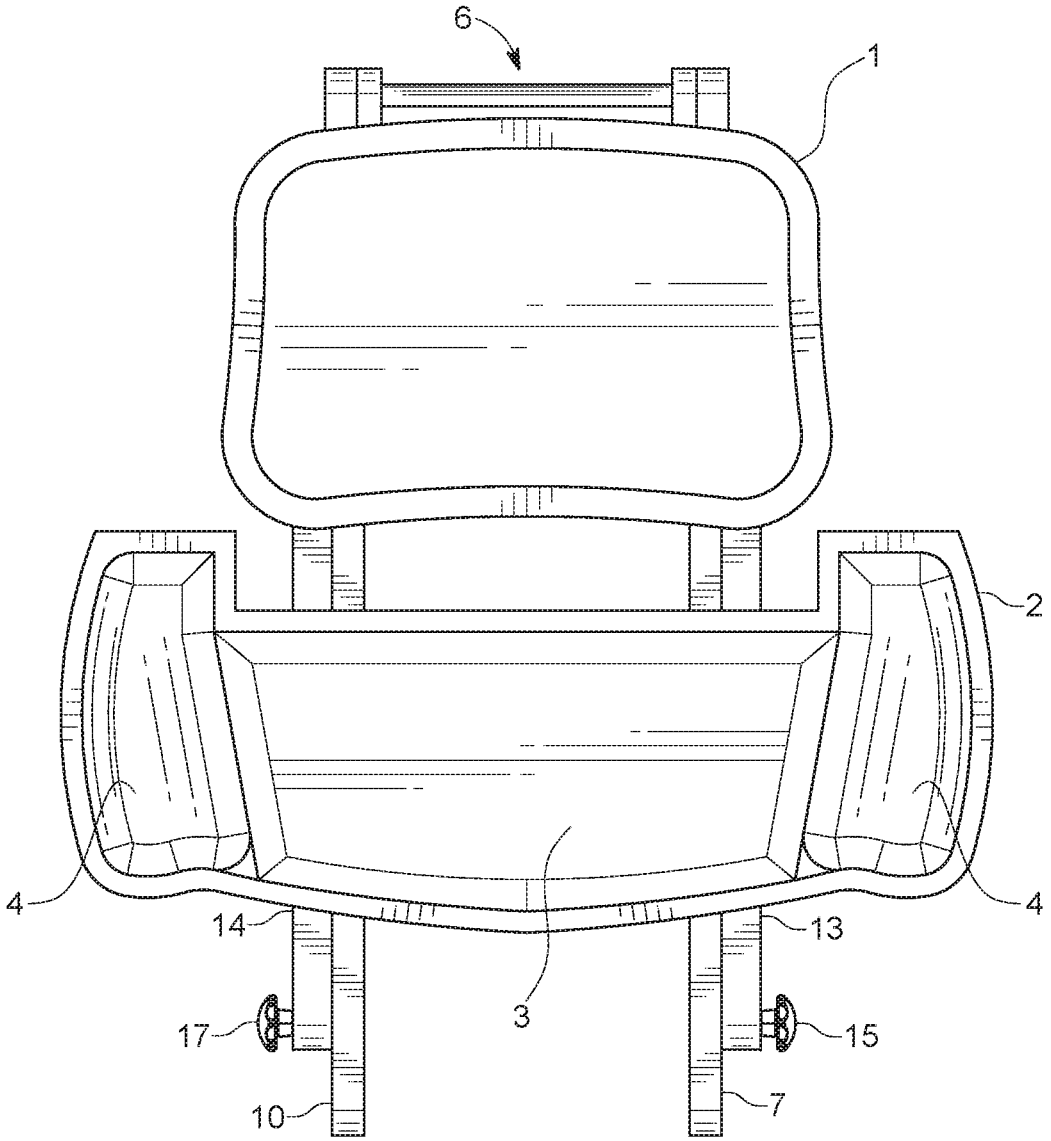
FIG. 2 is a top view of a seated support apparatus in one exemplary embodiment.
Figure 3:
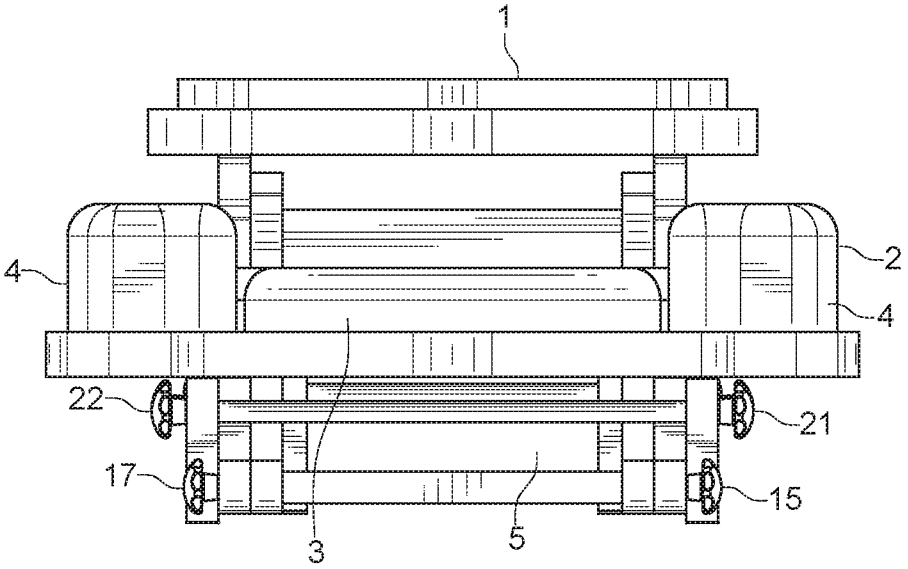
FIG. 3 is a front view of a seated support apparatus in one exemplary embodiment.
Figure 4:
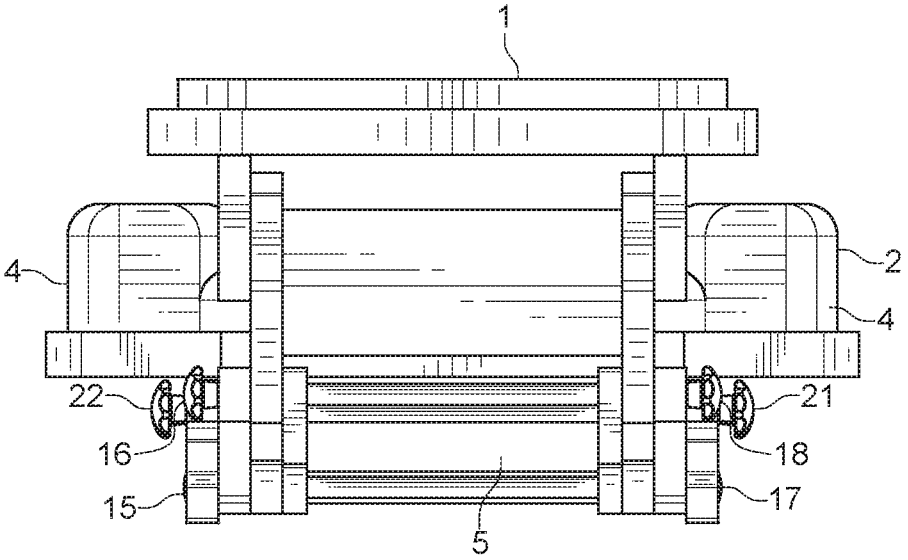
FIG. 4 is a rear view of a seated support apparatus in one exemplary embodiment.
Figure 5A:
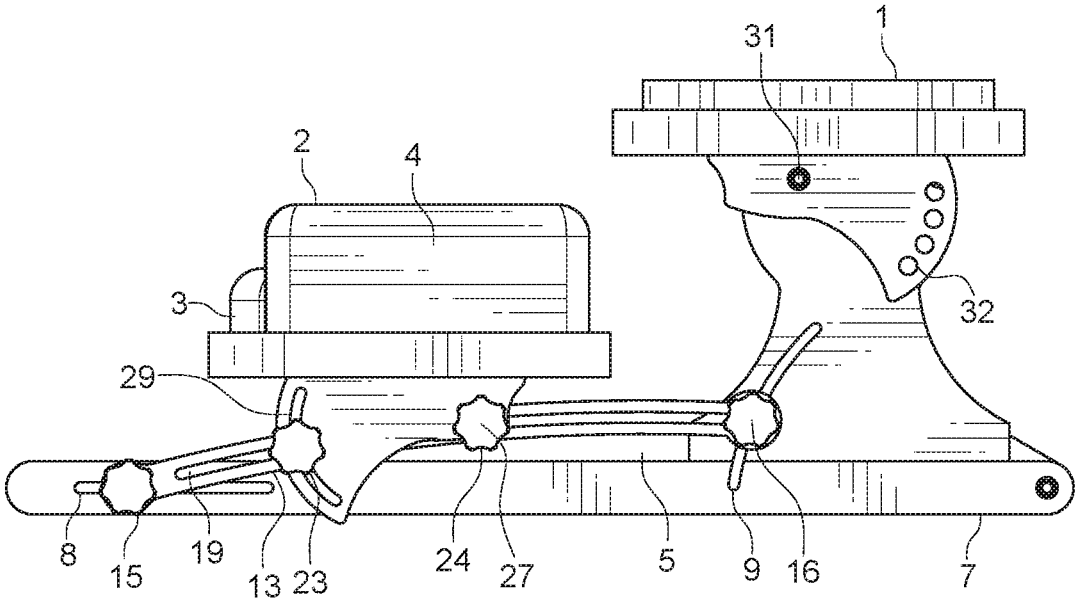
FIG. 5*a* is a side view of a seated support apparatus with a combined translate-and-cant reposition carriage in a first position in one exemplary embodiment.
Figure 5B:
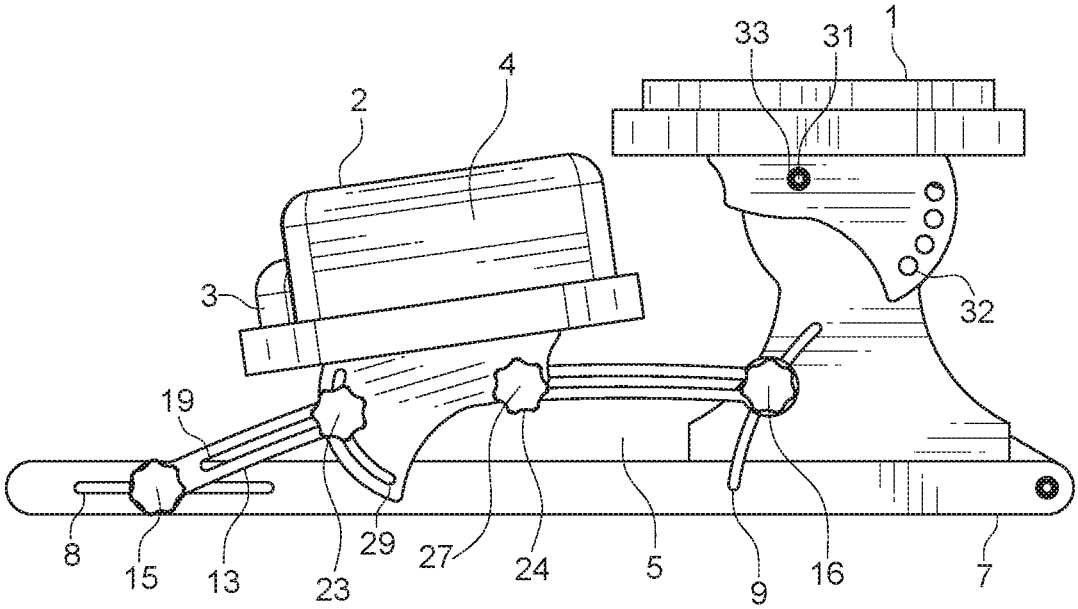
FIG. 5*b* is a side view of a seated support apparatus with a combined translate-and-cant reposition carriage in a second position in one exemplary embodiment.
Figure 6A:
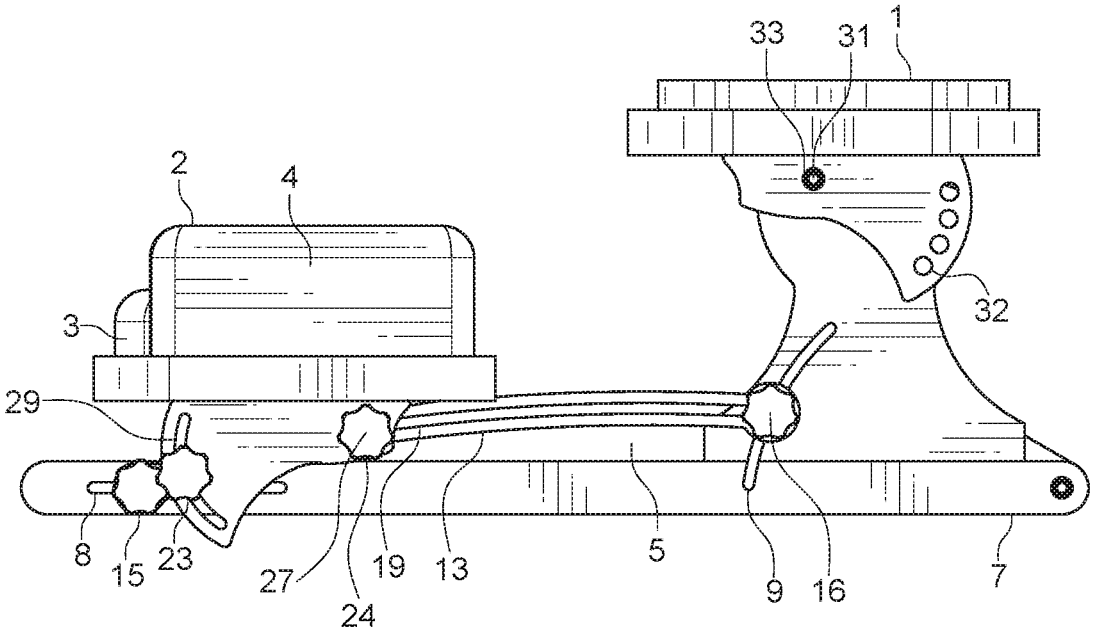
FIG. 6*a* is a side view of a seated support apparatus with a leg rest in a first position in one exemplary embodiment.
Figure 6B:
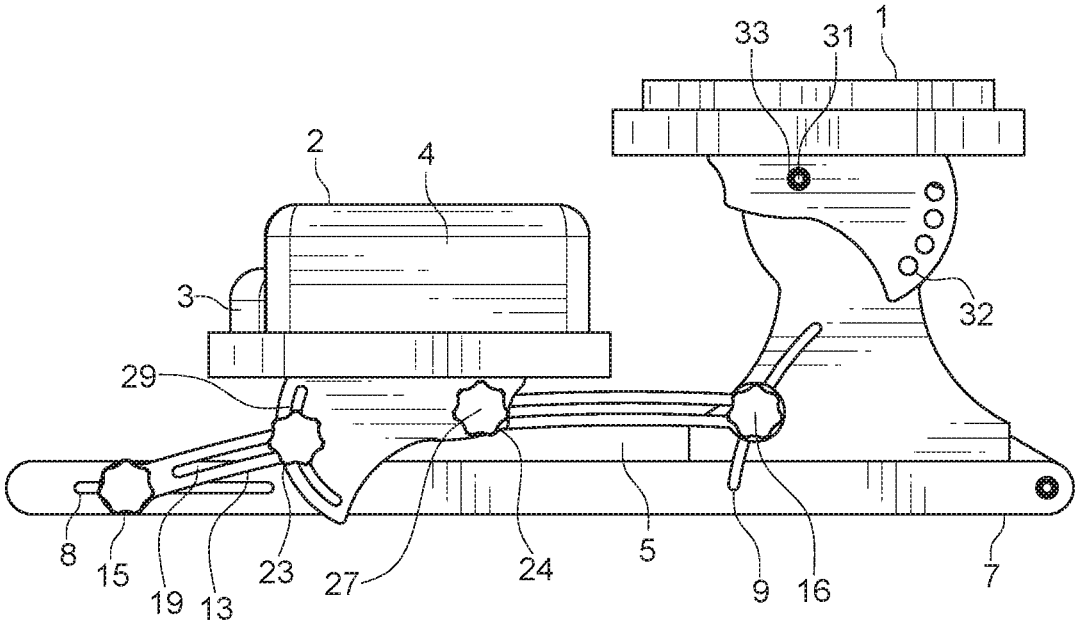
FIG. 6*b* is a side view of a seated support apparatus with a leg rest in a second position in one exemplary embodiment.
Figure 7A:
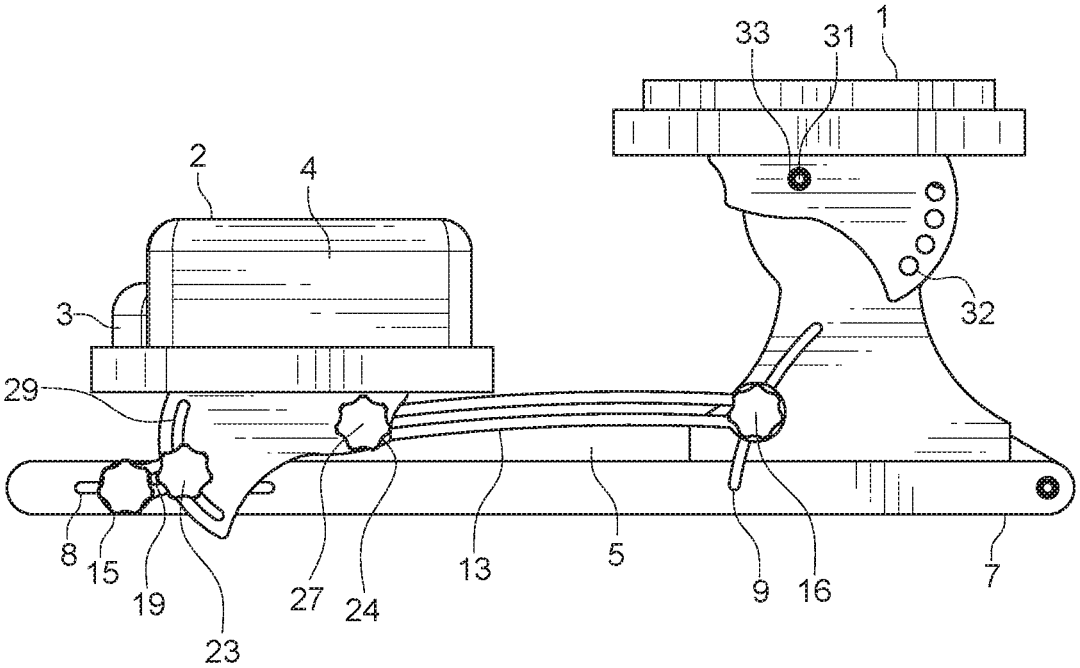
FIG. 7*a* is a side view of a seated support apparatus with a tiltable leg rest in a first tilt in one exemplary embodiment.
Figure 7B:
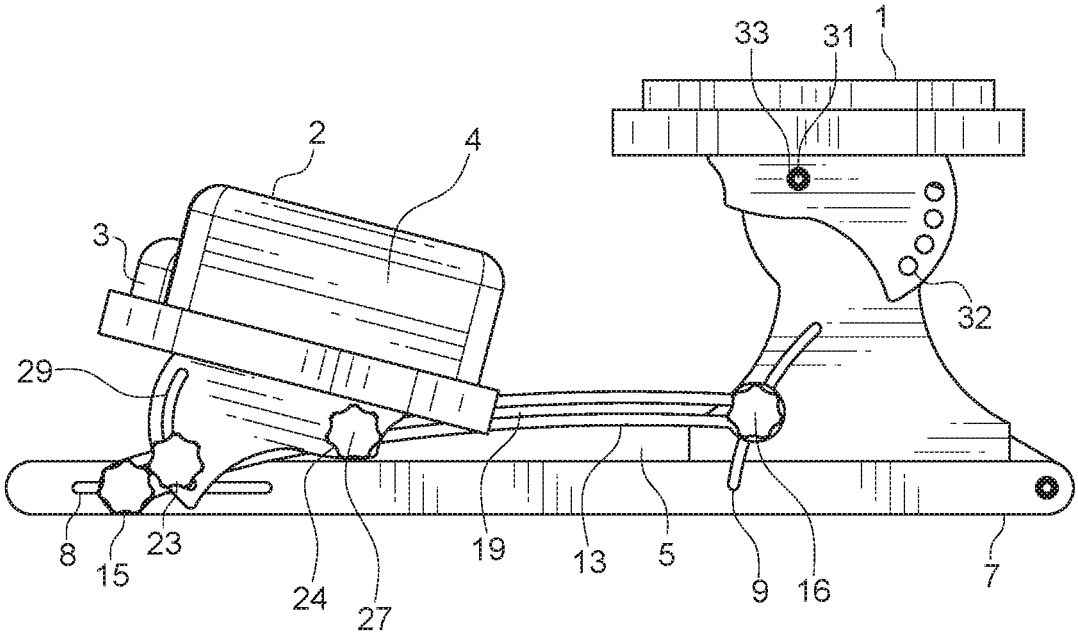
FIG. 7*b* is a side view of a seated support apparatus with a tiltable leg rest in a second tilt in one exemplary embodiment.
Figure 8A:
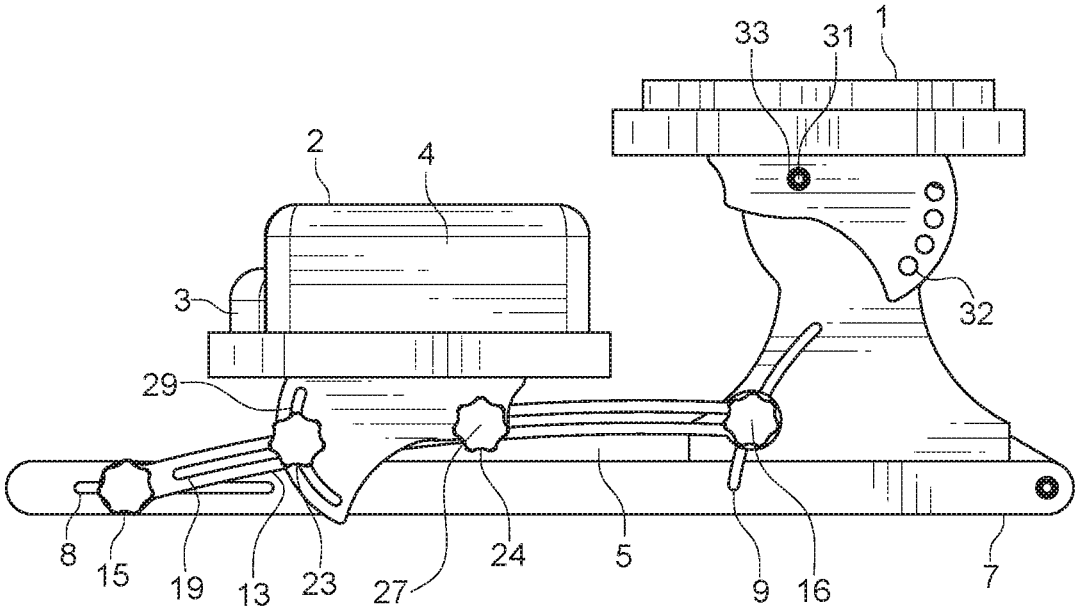
FIG. 8*a* is a side view of a seated support apparatus with a tiltable seat rest in a first tilt in one exemplary embodiment.
Figure 8B:
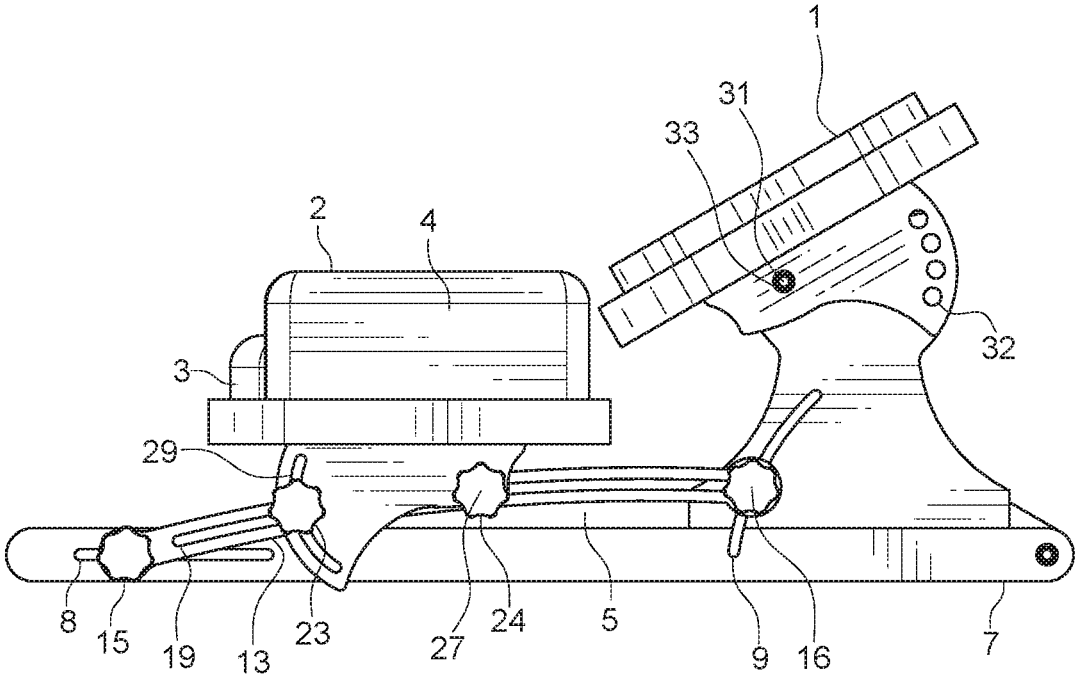
FIG. 8*b* is a side view of a seated support apparatus with a tiltable seat rest in a second tilt in one exemplary embodiment.

46. A method for seated support as described in clause 27 or any other clause, wherein said step of simultaneously translating and canting comprises the step of fixing the relationship of said translation to said cant.
47. A method for seated support as described in clause 46, or any other clause, further comprising the step of translating said leg rest on said combined translate-and-cant reposition carriage.
48. A method for seated support as described in clause 47, or any other clause, further comprising the step of tilting said leg rest on said combined translate-and-cant reposition carriage.
49. A method for seated support as described in clause 48, or any other clause, further comprising the step of tilting said seat rest.
50. A method for seated support as described in clause 27 or any other clause, wherein said steps of supporting and simultaneously translating and canting comprise the step of balancing said user in equipoise.
51. A method for seated support as described in clause 50 or any other clause, wherein said step of balancing said user in equipoise comprises a step selected from the group consisting of allowing said user to freely float in equipoise, locking said equipoise balance in place, partially locking said equipoise balance in place, driving said equipoise balance with said seat rest, and driving equipoise balance with said leg rest.
52. A method for seated support as described in clause 51 or any other clause, wherein said step of balancing said user equipoise further comprises a step selected from the group consisting of translating said leg rest on said combined translate-and-cant reposition carriage, tilting said leg rest on said combined translate-and-cant reposition carriage, tilting said seat rest, and any combination of the foregoing.
53. A system substantially as herein described with reference to any one or more of the Figures and Description.
54. A process according to clause 27, or any other clause, and further comprising any of the steps as shown in FIGS. 1-12, separately, in any combination or permutation.

As can be easily understood from the foregoing, the basic concepts of the present inventive technology may be embodied in a variety of ways. It involves both seated support techniques as well as devices to accomplish the appropriate seated support. In this application, the seated support techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this patent application is intended to serve as a basic description. The reader should be aware that the specific discussion may not explicitly describe all embodiments possible; many alternatives are implicit. It also may not fully explain the generic nature of the inventive technology and may not explicitly show how each feature or element can actually be representative of a broader function or of a great variety of alternative or equivalent elements. Again, these are implicitly included in this disclosure. Where the inventive technology is described in device-oriented terminology, each element of the device implicitly performs a function. Apparatus claims may not only be included for the device described, but also method or process claims may be included to address the functions the inventive technology and each element performs. Neither the description nor the terminology is intended to limit the scope of the claims that will be included in any subsequent patent application.

It should also be understood that a variety of changes may be made without departing from the essence of the inventive technology. Such changes are also implicitly included in the description. They still fall within the scope of this inventive technology. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "support" should be understood to encompass disclosure of the act of "supporting"—whether explicitly discussed or not—and, conversely, were there effectively disclosure of the act of "supporting", such a disclosure should be understood to encompass disclosure of a "support" and even a "means for supporting" Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the seated support devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A seated support apparatus comprising:

a seat rest configured to support the posterior of a user;

a leg rest configured to support a leg portion of said user;

a combined translate-and-cant reposition carriage configured to simultaneously translate and cant the position of said leg rest in relation to said seat rest;

and further comprising an H-shaped base having:

a left forward translate-and-cant slot and a left rear translate-and-cant slot of a left leg of said H-shaped base;

a right forward translate-and-cant slot and a right rear translate-and-cant slot of a right leg of said H-shaped base;

and wherein said combined translate-and-cant reposition carriage comprises:

a left rail joined to said left leg of said H-shaped base at a left forward crosspiece disposed through said left forward translate-and-cant slot and a left rear crosspiece disposed through said left rear translate and cant slot;

a right rail joined to said right leg of said H-shaped base at a right forward crosspiece disposed through said right forward translate-and-cant slot and a right rear crosspiece disposed through said right rear translate and cant slot.

2. A seated support apparatus as described in claim 1 wherein said combined translate-and-cant reposition carriage comprises a combined translate-and-cant reposition carriage configured to translate and cant the position of said leg rest in a fixed relationship defined by the cooperation of the movement of said crosspieces in said slots.

3. A seated support apparatus as described in claim 1 wherein each said forward translate-and-cant slot comprises a substantially horizontal translate-and-cant slot, and wherein each said rear translate-and-cant slot comprises a substantially non-horizontal translate-and-cant slot.

4. A seated support apparatus as described in claim 1 wherein each said forward translate-and-cant slot comprises a substantially straight translate-and-cant slot, and wherein each said rear translate-and-cant slot comprises a substantially arcuate translate-and-cant slot.

5. A seated support apparatus as described in claim 1 wherein said leg rest comprises a translatable leg rest.

6. A seated support apparatus as described in claim 5 wherein said translate-and-cant reposition carriage further comprises:

a left leg rest translation slot of said left rail of said translate-and-cant reposition carriage;

a right leg rest translation slot of said right rail of said translate-and-cant reposition carriage;

and wherein said translatable leg rest comprises:

a left leg rest translation crosspiece disposed through said left leg rest translation slot of said left rail;

a right leg rest translation crosspiece disposed through said right leg rest translation slot.

7. A seated support apparatus as described in claim 6 wherein said leg rest comprises a tiltable leg rest.

8. A seated support apparatus as described in claim 7 wherein:

said left leg rest translation crosspiece comprises a front left leg rest translation crosspiece disposed through said left leg rest translation slot of said left rail, and further comprising a rear left leg rest translation crosspiece disposed through said left leg rest translation slot of said left rail;

said right leg rest translation crosspiece comprises a front right leg rest translation crosspiece disposed through said right leg rest translation slot of said right rail, and further comprising a rear right leg rest translation crosspiece disposed through said right leg rest translation slot of said right rail;

and wherein said tiltable leg rest comprises:

a left pivot point of said tiltable leg rest joined to said rear left leg rest translation crosspiece and a right pivot point of said tiltable leg rest joined to said rear right leg rest translation crosspiece;

a left tilt slot of said tiltable leg rest through which said front left leg rest translation crosspiece is disposed and a right tilt slot of said tiltable leg rest through which said front right leg rest translation crosspiece is disposed.

9. A seated support apparatus as described in claim 8 wherein said seat rest comprises a seat rest tiltably joined to said H-shaped base.

10. A seated support apparatus as described in claim 9 wherein said H-shaped base comprises:

at least one seat rest pivot point of said H-shaped base;

at least one seat rest pivot slot of said H-shaped base;

and wherein said seat rest tiltably joined to said H-shaped base comprises:

at least one seat rest pivot point of said seat rest joined to said at least one seat rest pivot point of said H-shaped base;

at least one seat rest crosspiece disposed through said at least one seat rest pivot slot of said H-shaped base.

11. A seated support apparatus as described in claim 10 wherein any said crosspiece comprises a tightening member.

12. A seated support apparatus as described in claim 10 wherein any said crosspiece comprises part of a lateral support of said H-shaped base.

13. A seated support apparatus as described in claim 10 wherein any said slot comprises a slot selected from the group consisting of a substantially straight slot, a substantially arcuate slot, a substantially horizontal slot, a substantially non-horizontal slot, a slot having a relatively higher position to another slot, a slot having a relatively lower position to another slot, any slot having any combination of the foregoing, and any combination of slots having any combinations of the foregoing.

14. A seated support apparatus as described in claim 10 wherein at least one said crosspiece comprises a self-positioning crosspiece configured to respond to a user attribute selected from the group consisting of the seated weight of said user and the seated position of said user.

15. A seated support apparatus as described in claim 14 wherein all said self-positioning crosspieces comprise an equipoise balancer for said user.

16. A seated support apparatus as described in claim 15 wherein said equipoise balancer comprises a free-floating equipoise balancer.

17. A seated support apparatus as described in claim 15 wherein said equipoise balancer comprises an equipoise balancer selected from the group consisting of a lockable equipoise balancer and partially lockable equipoise balancer.

18. A seated support apparatus as described in claim 15 wherein said equipoise balancer comprises an equipoise balancer selected from the group consisting of a seat rest driven equipoise balancer and a leg rest driven equipoise balancer.

19. A seated support apparatus as described in claim 1 wherein said combined translate-and-cant reposition carriage comprises a combined translate-and-cant reposition carriage configured to simultaneously translate and cant the position of said leg rest in a fixed relationship.

20. A seated support apparatus as described in claim 19 wherein said leg rest comprises a translatable leg rest configured for translation on said combined translate-and-cant reposition carriage.

21. A seated support apparatus as described in claim 20 wherein said translatable leg rest further comprises a tiltable translatable leg rest configured for tilt on said combined translate-and-cant reposition carriage.

22. A seated support apparatus as described in claim 21 wherein said seat rest comprises a tiltable seat rest.

23. A seated support apparatus as described in claim 1 wherein said seat rest, said leg rest, and said combined translate-and-cant reposition carriage comprise an equipoise balancer for said user.

24. A seated support apparatus as described in claim 23, wherein said equipoise balancer comprises an equipoise balancer selected from the group consisting of a free-floating equipoise balancer, a lockable equipoise balancer, a partially lockable equipoise balancer, a seat rest driven equipoise balancer, and a leg rest driven equipoise balancer.

25. A seated support apparatus as described in claim 23 wherein said leg rest comprises a translatable leg rest configured for translation on said combined translate-and-cant reposition carriage, and wherein said translatable leg rest further comprises a tiltable translatable leg rest configured for tilt on said combined translate-and-cant reposition carriage, and wherein said seat rest comprises a tiltable seat rest.

26. A seated support apparatus comprising:

a seat rest configured to support the posterior of a user;

a leg rest configured to support a leg portion of said user;

a combined translate-and-cant reposition carriage configured to simultaneously translate and cant the position of said leg rest in relation to said seat rest;

and wherein said seat rest, said leg rest, and said combined translate-and-cant reposition carriage comprise an equipoise balancer for said user;

and wherein said leg rest comprises a translatable leg rest configured for translation on said combined translate-and-cant reposition carriage;

and wherein said translatable leg rest further comprises a tiltable translatable leg rest configured for tilt on said combined translate-and-cant reposition carriage;

and wherein said seat rest comprises a tiltable seat rest.

27. A seated support apparatus as described in claim 26 further comprising an H-shaped base having:

a left forward translate-and-cant slot and a left rear translate-and-cant slot of a left leg of said H-shaped base;

a right forward translate-and-cant slot and a right rear translate-and-cant slot of a right leg of said H-shaped base;

and wherein said combined translate-and-cant reposition carriage comprises:

a left rail joined to said left leg of said H-shaped base at a left forward crosspiece disposed through said left forward translate-and-cant slot and a left rear crosspiece disposed through said left rear translate and cant slot;

a right rail joined to said right leg of said H-shaped base at a right forward crosspiece disposed through said right forward translate-and-cant slot and a right rear crosspiece disposed through said right rear translate and cant slot.

28. A seated support apparatus as described in claim 27 wherein said combined translate-and-cant reposition carriage comprises a combined translate-and-cant reposition carriage configured to translate and cant the position of said leg rest in a fixed relationship defined by the cooperation of the movement of said crosspieces in said slots.

29. A seated support apparatus as described in claim 27 wherein each said forward translate-and-cant slot comprises a substantially horizontal translate-and-cant slot, and wherein each said rear translate-and-cant slot comprises a substantially non-horizontal translate-and-cant slot.

30. A seated support apparatus as described in claim 27 wherein each said forward translate-and-cant slot comprises a substantially straight translate-and-cant slot, and wherein each said rear translate-and-cant slot comprises a substantially arcuate translate-and-cant slot.

31. A seated support apparatus as described in claim 27 wherein said leg rest comprises a translatable leg rest.

32. A seated support apparatus as described in claim 31 wherein said translate-and-cant reposition carriage further comprises:

a left leg rest translation slot of said left rail of said translate-and-cant reposition carriage;

a right leg rest translation slot of said right rail of said translate-and-cant reposition carriage;

and wherein said translatable leg rest comprises:

a left leg rest translation crosspiece disposed through said left leg rest translation slot of said left rail;

a right leg rest translation crosspiece disposed through said right leg rest translation slot.

33. A seated support apparatus as described in claim 32 wherein said leg rest comprises a tiltable leg rest.

34. A seated support apparatus as described in claim 33 wherein:

said left leg rest translation crosspiece comprises a front left leg rest translation crosspiece disposed through said left leg rest translation slot of said left rail, and further comprising a rear left leg rest translation crosspiece disposed through said left leg rest translation slot of said left rail;

said right leg rest translation crosspiece comprises a front right leg rest translation crosspiece disposed through said right leg rest translation slot of said right rail, and further comprising a rear right leg rest translation crosspiece disposed through said right leg rest translation slot of said right rail;

and wherein said tiltable leg rest comprises:

a left pivot point of said tiltable leg rest joined to said rear left leg rest translation crosspiece and a right pivot point of said tiltable leg rest joined to said rear right leg rest translation crosspiece;

a left tilt slot of said tiltable leg rest through which said front left leg rest translation crosspiece is disposed and a right tilt slot of said tiltable leg rest through which said front right leg rest translation crosspiece is disposed.

35. A seated support apparatus as described in claim 34 wherein said seat rest comprises a seat rest tiltably joined to said H-shaped base.

36. A seated support apparatus as described in claim 35 wherein said H-shaped base comprises:

at least one seat rest pivot point of said H-shaped base;

at least one seat rest pivot slot of said H-shaped base;

and wherein said seat rest tiltably joined to said H-shaped base comprises:

at least one seat rest pivot point of said seat rest joined to said at least one seat rest pivot point of said H-shaped base;

at least one seat rest crosspiece disposed through said at least one seat rest pivot slot of said H-shaped base.

37. A seated support apparatus as described in claim 36 wherein any said crosspiece comprises a tightening member.

38. A seated support apparatus as described in claim 36 wherein any said crosspiece comprises part of a lateral support of said H-shaped base.

39. A seated support apparatus as described in claim 36 wherein any said slot comprises a slot selected from the group consisting of a substantially straight slot, a substantially arcuate slot, a substantially horizontal slot, a substantially non-horizontal slot, a slot having a relatively higher position to another slot, a slot having a relatively lower position to another slot, any slot having any combination of the foregoing, and any combination of slots having any combinations of the foregoing.

40. A seated support apparatus as described in claim 36 wherein at least one said crosspiece comprises a self-positioning crosspiece configured to respond to a user attribute selected from the group consisting of the seated weight of said user and the seated position of said user.

41. A seated support apparatus as described in claim 40 wherein all said self-positioning crosspieces comprise an equipoise balancer for said user.

42. A seated support apparatus as described in claim 41 wherein said equipoise balancer comprises a free-floating equipoise balancer.

43. A seated support apparatus as described in claim 41 wherein said equipoise balancer comprises an equipoise balancer selected from the group consisting of a lockable equipoise balancer and partially lockable equipoise balancer.

44. A seated support apparatus as described in claim 41 wherein said equipoise balancer comprises an equipoise balancer selected from the group consisting of a seat rest driven equipoise balancer and a leg rest driven equipoise balancer.

45. A seated support apparatus as described in claim 26 wherein said combined translate-and-cant reposition carriage comprises a combined translate-and-cant reposition carriage configured to simultaneously translate and cant the position of said leg rest in a fixed relationship.

46. A seated support apparatus as described in claim 45 wherein said leg rest comprises a translatable leg rest configured for translation on said combined translate-and-cant reposition carriage.

47. A seated support apparatus as described in claim 46 wherein said translatable leg rest further comprises a tiltable translatable leg rest configured for tilt on said combined translate-and-cant reposition carriage.

48. A seated support apparatus as described in claim 47 wherein said seat rest comprises a tiltable seat rest.

49. A seated support apparatus as described in claim 26, wherein said equipoise balancer comprises an equipoise balancer selected from the group consisting of a free-floating equipoise balancer, a lockable equipoise balancer, a partially lockable equipoise balancer, a seat rest driven equipoise balancer, and a leg rest driven equipoise balancer.

* * * * *